US012478829B2

(12) United States Patent
Wang et al.

(10) Patent No.: US 12,478,829 B2
(45) Date of Patent: Nov. 25, 2025

(54) TREADMILL

(71) Applicants: BEIJING XIAOMI MOBILE SOFTWARE CO., LTD., Beijing (CN); Beijing Kingsmith Technology Co., Ltd., Beijing (CN)

(72) Inventors: Yunsong Wang, Beijing (CN); Xianbing Bai, Beijing (CN)

(73) Assignees: BEIJING XIAOMI MOBILE SOFTWARE CO., LTD., Beijing (CN); Beijing Kingsmith Technology Co., Ltd., Beijing (CN)

( * ) Notice: Subject to any disclaimer, the term of this patent is extended or adjusted under 35 U.S.C. 154(b) by 186 days.

(21) Appl. No.: 18/343,862

(22) Filed: Jun. 29, 2023

(65) Prior Publication Data

US 2024/0216752 A1 Jul. 4, 2024

(30) Foreign Application Priority Data

Dec. 30, 2022 (CN) ..... 202223603510.7

(51) Int. Cl.
*A63B 22/02* (2006.01)

(52) U.S. Cl.
CPC ..... *A63B 22/0235* (2013.01); *A63B 2210/50* (2013.01)

(58) Field of Classification Search
CPC . A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 2022/0271; A63B 2022/0278; A63B 2210/50; F16B 5/02
See application file for complete search history.

(56) References Cited

U.S. PATENT DOCUMENTS

| | | | | |
|---|---|---|---|---|
| 11,998,796 | B2 * | 6/2024 | Luo | A63B 21/023 |
| 12,023,544 | B2 * | 7/2024 | Hu | A63B 21/4035 |
| 2011/0021323 | A1 * | 1/2011 | Wu | A63B 22/0235 482/54 |

(Continued)

FOREIGN PATENT DOCUMENTS

| | | | |
|---|---|---|---|
| CN | 210020972 | U | 2/2020 |
| CN | 113426065 | A | 9/2021 |

(Continued)

OTHER PUBLICATIONS

Extended European Search Report issued May 15, 2024, in corresponding European Patent Application No. 23183008.4, 9 pages.

(Continued)

*Primary Examiner* — Joshua Lee
(74) *Attorney, Agent, or Firm* — Oblon, McClelland, Maier & Neustadt, L.L.P.

(57) ABSTRACT

A treadmill includes a running deck and belt assembly and an upright post. The upright post is movably connected with the running deck and belt assembly through a movable connecter, and the upright post is configured to rotate relative to the running deck and belt assembly around the movable connecter which serves as a fixed point, to allow the treadmill to have a used state and a folded state during rotation.

13 Claims, 5 Drawing Sheets

(56) References Cited

U.S. PATENT DOCUMENTS

| | | | | |
|---|---|---|---|---|
| 2015/0051051 | A1* | 2/2015 | Liu | A63B 22/02 482/54 |
| 2021/0402279 | A1* | 12/2021 | Luo | A63B 22/02 |
| 2022/0331648 | A1* | 10/2022 | Hu | A63B 22/02 |
| 2023/0136863 | A1* | 5/2023 | Luo | A63B 21/023 482/54 |

FOREIGN PATENT DOCUMENTS

| | | | |
|---|---|---|---|
| CN | 215841411 | U | 2/2022 |
| CN | 217645761 | U | 10/2022 |
| CN | 115253166 | A | 11/2022 |
| CN | 217854342 | U | 11/2022 |
| JP | 2021-194535 | A | 12/2021 |

OTHER PUBLICATIONS

Office Action issued May 28, 2024, in corresponding Japanese Patent Application No. 2023-090042 (with English Translation), 10 pages.

Office Action issued Dec. 19, 2023, in corresponding Japanese Patent Application No. 2023-090042 (with English Translation), 10 pages.

Korean Office Action dated Jul. 25, 2025, issued in Korean Application No. 10-2023-0070225 (with English translation; Documents 15 and 16 cited therein).

* cited by examiner

TREADMILL

CROSS-REFERENCE TO RELATED APPLICATION

This application is based on and claims priority to Chinese Patent Application No. 202223603510.7 filed on Dec. 30, 2022, the entire contents of which are incorporated herein by reference for all purposes.

BACKGROUND

Technical Field

A treadmill generally needs to be folded and stored because of its large structural size, so as to save storage space. In the related art, the treadmill with upright posts has a locked state and an unlocked-folded state in use. However, in the process of switching from the locked state to the folded state, there is a problem that the upright post of the treadmill suddenly falls down due to gravity after unlocking, thus resulting in potential safety hazards in use.

SUMMARY

The present disclosure relates to a field of sports equipment, and more particularly to a treadmill.

Embodiments of the present disclosure provide a treadmill, and the treadmill includes a running deck and belt assembly and an upright post. The upright post is arranged at a front end of the running deck and belt assembly. The upright post is movably connected with the running deck and belt assembly through a movable connecter, and configured to rotate relative to the running deck and belt assembly around the movable connecter which serves as a fixed point, to allow the treadmill to have a used state and a folded state during rotation. The used state refers to a state that the upright post is perpendicular or approximately perpendicular to an upper surface of the running deck and belt assembly, and the folded state refers to a state that the upright post is parallel or approximately parallel to the upper surface of the running deck and belt assembly.

It is to be understood that both the foregoing general description and the following detailed description are illustrative and explanatory only and do not limit the present disclosure.

BRIEF DESCRIPTION OF THE DRAWINGS

In order to explain the technical solution in the embodiment of the present disclosure more clearly, the drawings needed in the description of the embodiment will be briefly introduced below. Apparently, the drawings in the following description illustrate only some embodiments of the present disclosure. For those ordinary skilled in the related art, other drawings can be obtained according to these drawings without creative efforts.

DETAILED DESCRIPTION OF THE PREFERRED EMBODIMENTS

Here, illustrative embodiments will be described in detail, examples of which are shown in the accompanying drawings. When the following description refers to the drawings, unless otherwise specified, the same numbers in different drawings indicate the same or similar elements. The implementations described in the following illustrative embodiments do not represent all the implementations consistent with the present disclosure. Rather, they are merely examples of devices and methods consistent with some aspects of the present disclosure.

The terms used in the present disclosure are merely for the purpose of describing specific embodiments and are not intended to limit the present disclosure. Unless otherwise specified, technical terms or scientific terms used in the present disclosure shall have their ordinary meanings as understood by those ordinary skilled in the field. Terms such as "first", "second" and the like used in the present disclosure do not indicate any sequence, quantity or importance, but are merely used to distinguish different components. Likewise, similar words such as "one" or "a" do not limit the quantity, but indicate that there is at least one. If only "one" is referred to, it will be explained separately. Terms such as "a plurality of" or "several" mean two or more than two. Unless otherwise specified, similar words such as "front", "rear", "lower" and/or "upper", "top" and "bottom" are only for convenience of explanation, and are not limited to a position or a spatial orientation. Similar words such as "include" or "contain" mean that the element or object before "include" or "contain" encompasses the element or object and their equivalents listed after "include" or "contain", but do not exclude other elements or objects. Similar words such as "connect" or "join" are not limited to physical or mechanical connections, but may include electrical connections, no matter direct or indirect.

The treadmill usually needs to be folded and stored because of its large structural size, so as to save storage space. In the related art, the treadmill with upright posts has a locked state and an unlocked-folded state during usage. However, in the process of switching from the locked state to the unlocked-folded state, there is a problem that the upright post of the treadmill suddenly falls down due to gravity after unlocking, thus resulting in potential safety hazards in use.

Figure 1:
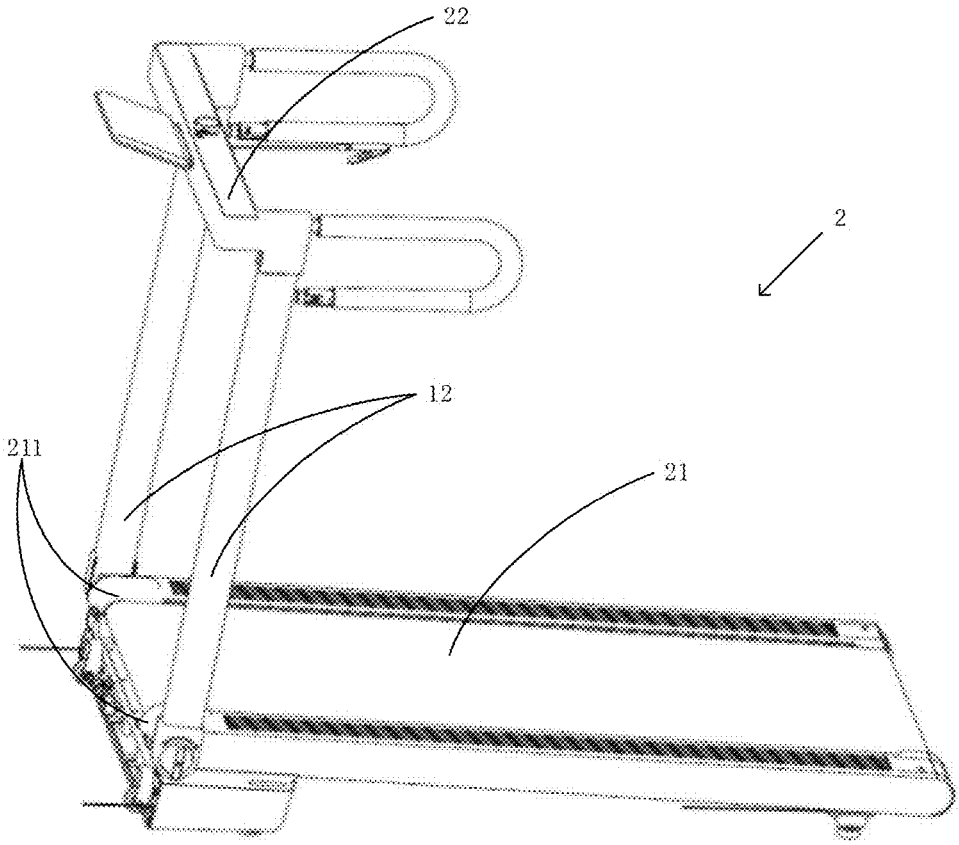
FIG. 1 is a perspective view of a treadmill in used state according to an illustrative embodiment of the present disclosure.
Figure 2:
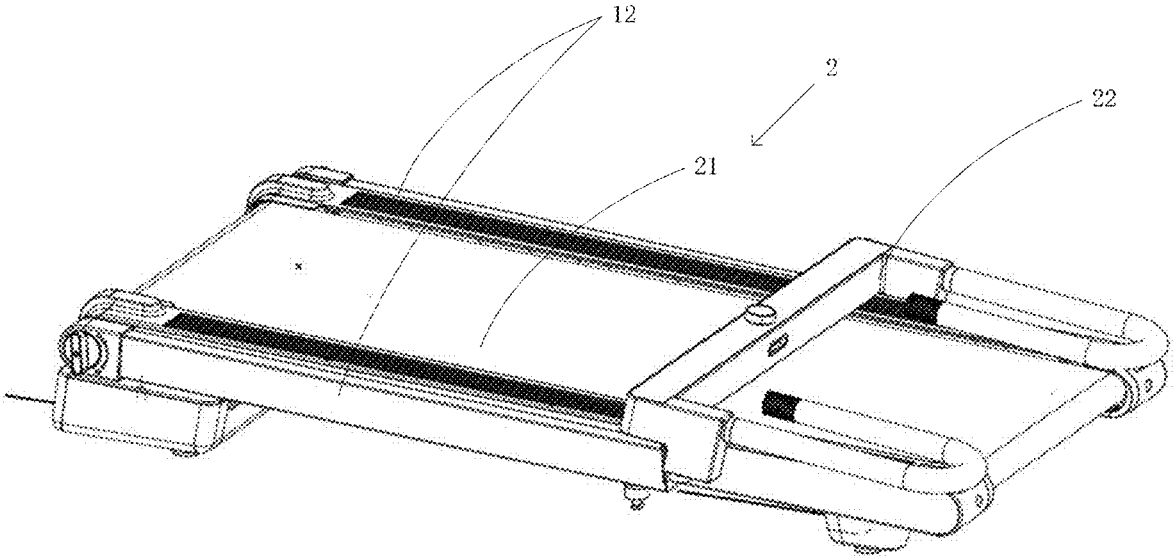
FIG. 2 is a perspective view of a treadmill in a folded state according to an illustrative embodiment of the present disclosure.
Figure 3:
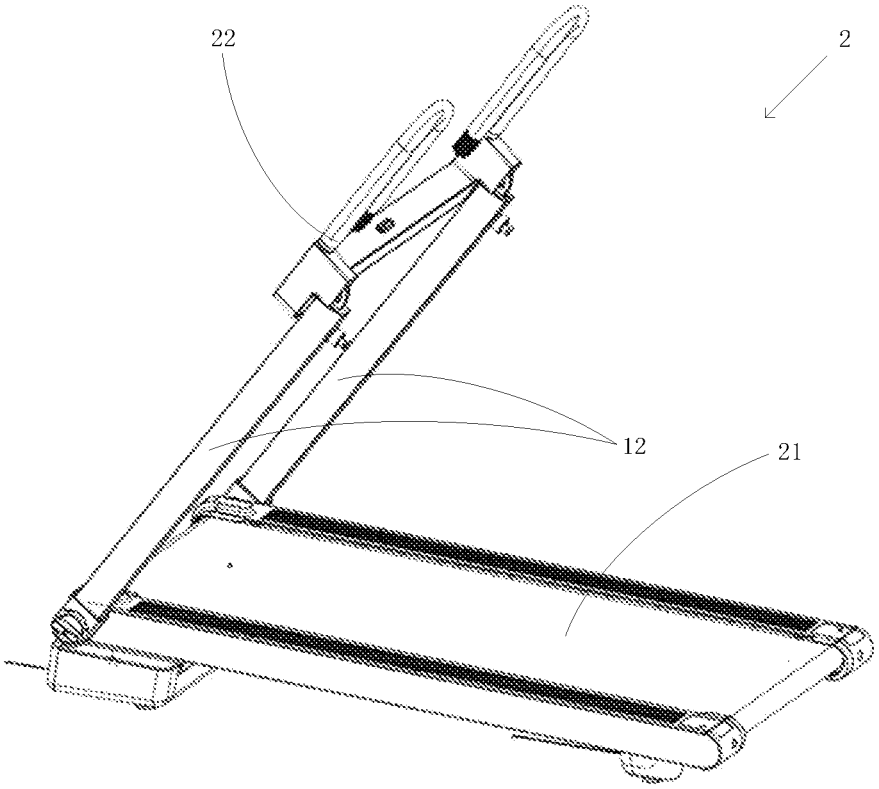
FIG. 3 is a perspective view of a treadmill in a suspended state according to an illustrative embodiment of the present disclosure.

The present disclosure provides a treadmill 2. FIG. 1 is a perspective view of a treadmill in a used state in an illustrative embodiment of the present disclosure, FIG. 2 is a perspective view of a treadmill in a folded state in an illustrative embodiment of the present disclosure, and FIG. 3 is a perspective view of a treadmill in a suspended state in an illustrative embodiment of the present disclosure. As shown in FIGS. 1-3, the treadmill 2 includes a running deck and belt assembly 21 and an upright post 12, and the upright post 12 is arranged at a front end of the running deck and belt assembly 21. The upright post 12 is movably connected with the running deck and belt assembly 21 through a movable connecter 23. The upright post 12 can rotate relative to the running deck and belt assembly 21 around the movable connecter 23 which serves as a fixed point, and in the process of rotation, the treadmill 2 has a used state and a folded state. The used state refers to a state that the upright post 12 is perpendicular or approximately perpendicular to an upper surface of the running deck and belt assembly 21, and the folded state refers to a state that the upright post 12 is parallel or approximately parallel to the upper surface of the running deck and belt assembly 21.

The upright post 12 is movably connected with the running deck and belt assembly 21 through the movable connecter 23, and the upright post 12 can rotate relative to the running deck and belt assembly 21 around the movable connecter 23 which serves as the fixed point. In the process of rotation, the treadmill 2 has the used state and the folded state, thus realizing the functions of folding and suspending at a preset angle, and improving the use flexibility and storage convenience of the treadmill 2.

In some embodiments, the upright post 12 has a suspended state in the process of rotating relative to the running deck and belt assembly 21 around the movable connecter 23 which serves as the fixed point. The suspended state refers to a state that an included angle between the upright post 12 and the upper surface of the running deck and belt assembly 21 is any value greater than 0 degrees and less than 90 degrees.

Figure 4:
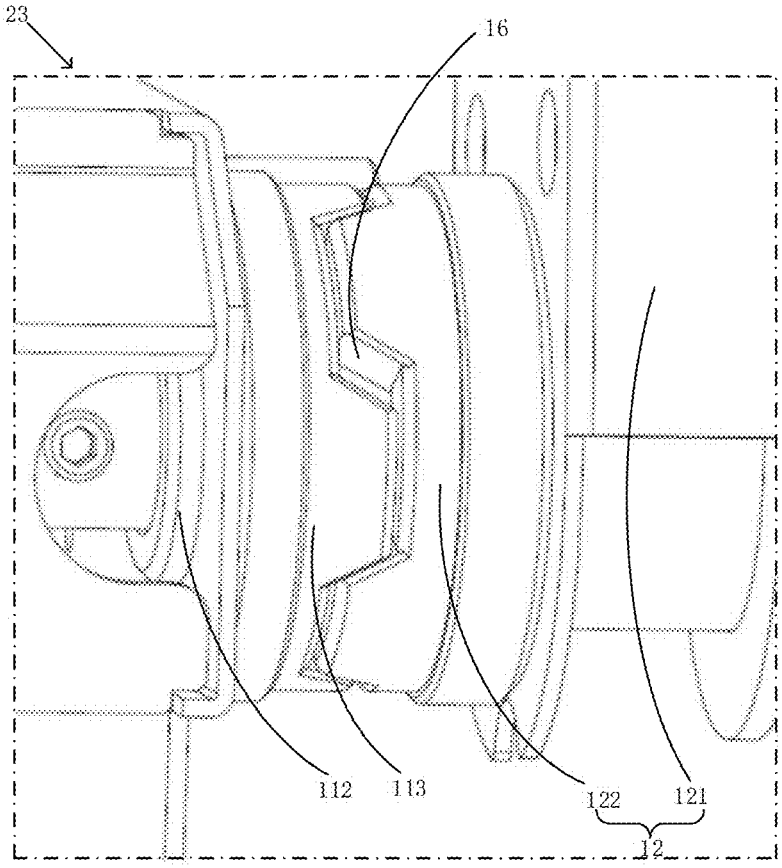
FIG. 4 is a partial view of a treadmill according to an illustrative embodiment of the present disclosure.
Figure 5:
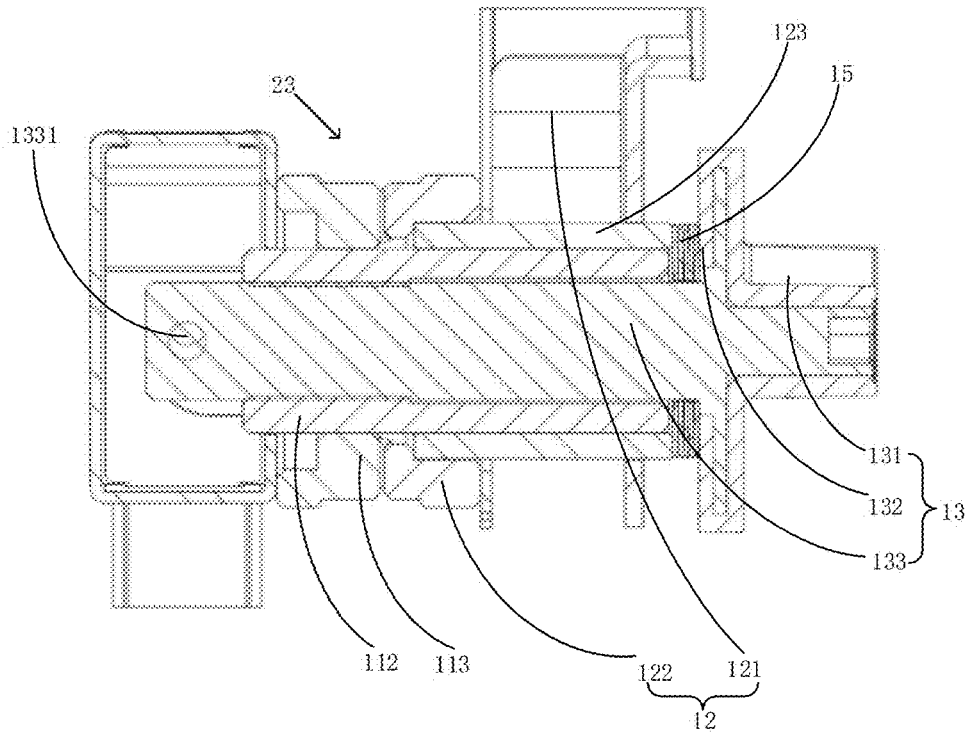
FIG. 5 is a cross-sectional view of a treadmill partial view an illustrative embodiment of the present disclosure.

In some embodiments, as shown in FIGS. 4 and 5, the movable connecter 23 includes a rotating shaft 112, a first chuck 113, a shaft sleeve 123, a second chuck 122 and a locking member 13. The rotating shaft 112 is fixed to the running deck and belt assembly 21, and has a hollow interior to form a locking cavity. The first chuck 113 is fixed to the running deck and belt assembly 21 and can be fitted over an outer surface of the rotating shaft 112. The shaft sleeve 123 is fixed to a lower end of the upright post 12 and can be fitted over the outer surface of the rotating shaft 112. The second chuck 122 is fixed to a side of the shaft sleeve 123 facing the running deck and belt assembly 21 and can be fitted over the outer surface of the rotating shaft 112. The locking member 13 is embedded in the locking cavity in the rotating shaft 112 and connected with the rotating shaft 112, and can move relative to the rotating shaft 112 in an axial direction of the rotating shaft 112 under the action of an external force.

The rotating shaft 112 can be welded and fixed to the running deck and belt assembly 21, the front end of the running deck and belt assembly 21 has a rotating shaft accommodating cavity, and the rotating shaft 112 is fixedly arranged in the rotating shaft accommodating cavity. The first chuck 113 can be welded and fixed to the running deck and belt assembly 21, and has a first through hole in its center, and a size of the first through hole matches with a size of the rotating shaft 112 so as to allow the first chuck 113 to be fitted over the outer surface of the rotating shaft 112. The shaft sleeve 123 can be welded and fixed to the lower end of the upright post 12 and can be fitted over the outer surface of the rotating shaft 112. A size of the shaft sleeve 123 matches with the size of the rotating shaft 112 so as to allow the shaft sleeve 123 to be fitted over the outer surface of the rotating shaft 112. The second chuck 122 has a second through hole in its center, and a size of the second through hole matches with the size of the rotating shaft 112 so as to allow the second chuck 122 to be fitted over the outer surface of the rotating shaft 112.

In some embodiments, the first chuck 113 and the second chuck 122 are engaged with each other, when the locking member 13 moves towards the rotating shaft 112 to a first predetermined position (i.e. a locked position) under the action of the external force. When the locking member 13 moves away from the rotating shaft 112 to a second predetermined position (i.e. an unlocked position) under the action of the external force, the first chuck 113 and the second chuck 122 are configured to be disengaged, that is, the second chuck 122 can be still engaged with the first chuck 113 without being subject to a force, when the locking member 13 is at the unlocked position, and can be disengaged from the first chuck 113 only when being subject to the force, as explained in detail below.

Since the locking member 13 can abut against the upright post 12 at the locked position, the second chuck 122 is snapped into the first chuck 113 to fix the upright post 12. When the locking member 13 is switched to the unlocked position, the second chuck 122 is still engaged with the first chuck 113 in an initial state without being subject to the force, thus avoiding the sudden falling of the upright post 12 and improving the use safety of the upright post 12. In addition, since the locking piece 13 does not apply any force to the upright post 12 to abut against the second chuck 122 in the unlocked position, the second chuck 122 can be disengaged from the first chuck 113 and enter a rotating and folding state under the action of the force, so that the functions of folding and suspending at the preset angle can be realized.

In the above embodiments, an outer surface of the locking member 13 has male threads, an inner surface of the locking cavity of the rotating shaft 112 has female threads, and the locking member 13 is connected with the rotating shaft 112 through the thread fit.

In some embodiments, the first chuck 113 and the second chuck 122 both include protrusions 17 and grooves 18, and the protrusions 17 and the grooves 18 of the first chuck 113 are fitted with the grooves 18 and the protrusions 17 of the second chuck 122 (that is, the protrusions 17 of the first chuck 113 are fitted with the grooves 18 of the second chuck 122, and the protrusions 17 of the second chuck 122 are fitted with the grooves 18 of the first chuck 113), so that the first chuck 113 and the second chuck 122 are engaged with each other. The first chuck 113 and the second chuck 122 are engaged and fixed by the fit of the protrusion 17 and the groove 18 having corresponding positions, and the rotation of the second chuck 122 relative to the first chuck 113 allows the protrusions 17 at different positions to be fitted with the grooves 18 (to be exact, for each groove 18, i.e. each groove 18 can be fitted with the protrusions 17 at different positions), so that the upright post 12 and the running deck and belt assembly 21 can assume an unfolded, suspended or folded posture of a preset angle. For example, the included angle between the upright post 12 and the running deck and belt assembly 21 may be 75°, 80°, 90°. 120°, etc., and the present disclosure does not limit the above included angle.

The protrusions 17 and the grooves 18 can be arranged in a variety of ways, and the present disclosure does not limit the specific arrangement of the protrusions 17 and the grooves 18.

The structures of the first chuck 113 and the second chuck 122 may be the same or slightly different, so long as the first chuck 113 and the second chuck 122 can be engaged. A case that the structures of the first chuck 113 and the second chuck 122 are the same is taken as an example.

Figure 6:
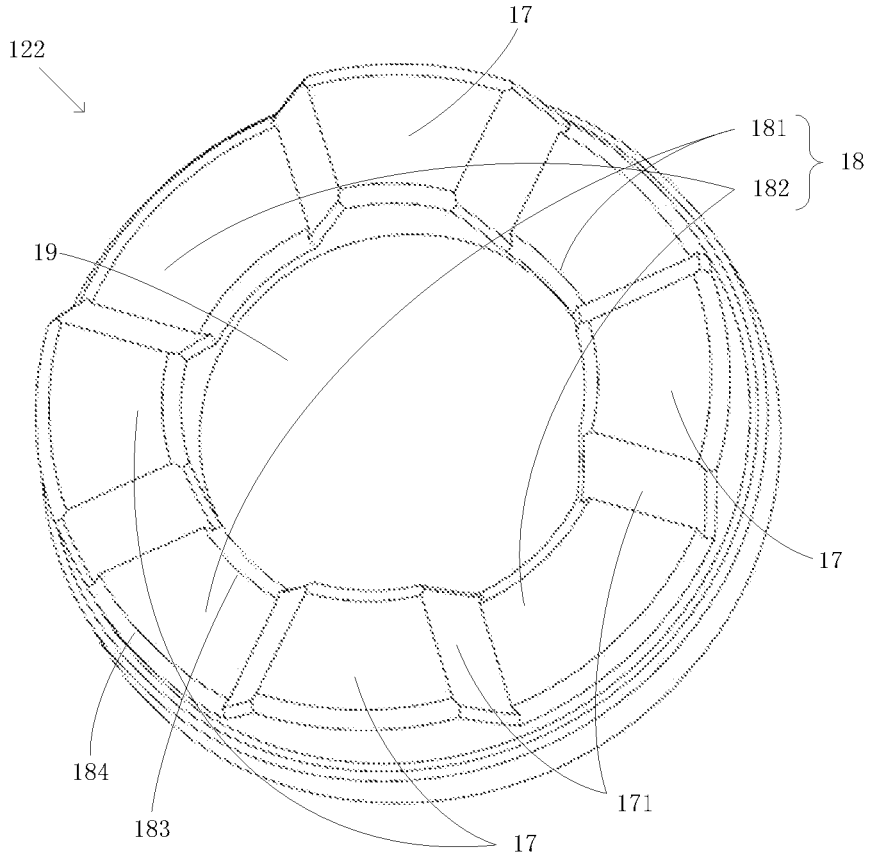
FIG. 6 is a schematic view of a second chuck partial view an illustrative embodiment of the present disclosure.

In some embodiments, as shown in FIG. 6, the first chuck 113 and the second chuck 122 include the protrusions 17 and the grooves 18 formed by lateral surfaces 171 of adjacent protrusions 17, and the lateral surfaces 171 of the protrusions 17 are inclined with respect to the axial direction.

When the second chuck 122 is engaged with the first chuck 113, the protrusion 17 is snapped into the groove 18. Since the groove 18 is formed by the lateral surfaces 171 of the adjacent projections 17, the structural configuration of the first chuck 113 and the second chuck 122 is simplified. The lateral surface 171 of the protrusion 17 is inclined relative to the axial direction, so that when the locking member 13 is in the unlocked position, the upright post 12 is subject to the force to drive the second chuck 122 to rotate relative to the first chuck 113, so that the protrusions 17 on the first chuck 113 and the second chuck 122 generate an axial thrust due to the lateral surfaces 171 inclined relative to the axial direction, and the second chuck 122 is disengaged from the first chuck 113 by the above axial thrust. After the second chuck 122 is disengaged from the first chuck 113, the upright post 12 is switched to the rotating and folding state. At this time, the upright post 12 can be folded or unfolded to a desired angle according to the needs of a user, and then the second chuck 122 is engaged and fixed with the first chuck 113 again by abutting against the upright post 12. The lateral surfaces 171 of the protrusions 17 inclined relative to the axial direction can provide the guidance and force for the engagement and disengagement of the second chuck 122 and the first chuck 113, thus improving the cooperation fluency of the first chuck 113 and the second chuck 122.

In an embodiment, the protrusion 17 and the groove 18 can be arranged in edge areas of the first chuck 113 and the second chuck 122, and an assembling hole 19 is formed on an inner side of the protrusion 17 and on an inner side of the groove 18. That is, each of the first chuck 113 and the second chuck 122 has the assembling hole 19 in its center. The rotating shaft 112 can be arranged in the assembling hole 19 of the first chuck 113 and pass through the assembling hole 19 of the second chuck 122 to be rotatably connected with the second chuck 122.

In other embodiments, the groove 18 can also be formed by a groove wall structure independent of the protrusion 17, so as to improve the flexibility of arranging the protrusion 17 and the groove 18. For example, the protrusion 17 and the groove 18 can be arranged at different positions in a radial direction of the chuck (i.e. the first chuck 113 or the second chuck 122), which helps to increase the number of the protrusions 17 and the grooves 18, and hence to increase the number of the suspending angles of the upright post 12, and also avoids the structure interference of the second chuck 122 with the first chuck 113 during rotation. It can be noted that the first chuck 113 and the second chuck 122 are fitted over the rotating shaft 112, and thus have the same radial direction.

It should be noted that the first chuck 113 and the second chuck 122 both can include at least two grooves 18, respectively, so that the protrusions 17 and the grooves 18 should be arranged at positions which can at least realize the unfolding of the upright post 12 to a working position relative to the running deck and belt assembly 21 and the folding of the upright post 12 to a storage position relative to the running deck and belt assembly 21. In addition, one or more pairs of the protrusions 17 and the grooves 18 can be provided according to the required suspending angle of the upright post 12.

In the above embodiments, the groove 18 may include an inner opening 183 and an outer opening 184 which are oppositely arranged in the radial direction of the first chuck 113 or the second chuck 122, and a circumferential dimension of the outer opening 184 is larger than that of the inner opening 183. That is, the groove 18 has a fan-shaped structure, to allow the lateral surface 171 of the protrusion 17 to further provide the axial thrust during the disengagement of the second chuck 122 from the first chuck 113, so that the disengagement of the second chuck 122 is labor-saving and smooth.

In some embodiments, the groove 18 may include a first groove 181 and a second groove 182. The first groove 181 structurally matches with the protrusion 17, and a circumferential dimension of the second groove 182 is larger than that of the protrusion 17. That is, the groove 18 located on one chuck may include the first groove 181 and the second groove 182, and the first groove 181 structurally matches with the protrusion 17, and there is no gap 16 between the protrusion 17 and the first groove 181 during the fit therebetween. There is a gap 16 between the protrusion 17 and the second groove 182 during the fit therebetween. The gap 16 can reduce the machining accuracy requirements of the first chuck 113 and the second chuck 122, and avoid the problem that the protrusion 17 cannot be snapped into the groove 18 during the alignment fit.

In the above embodiments, the first groove 181 and the second groove 182 can be alternately arranged. When the protrusions 17 and the grooves 18 are arranged in the edge areas of the first chuck 113 and the second chuck 122, and the groove 18 is formed by the lateral surfaces 171 of two adjacent protrusions 17, the first groove 181 and the second groove 182 are alternately arranged, and the problem that the protrusion 17 cannot be snapped into the groove 18 during the alignment fit can be effectively avoided through the gaps 16 formed at intervals.

Figure 7:
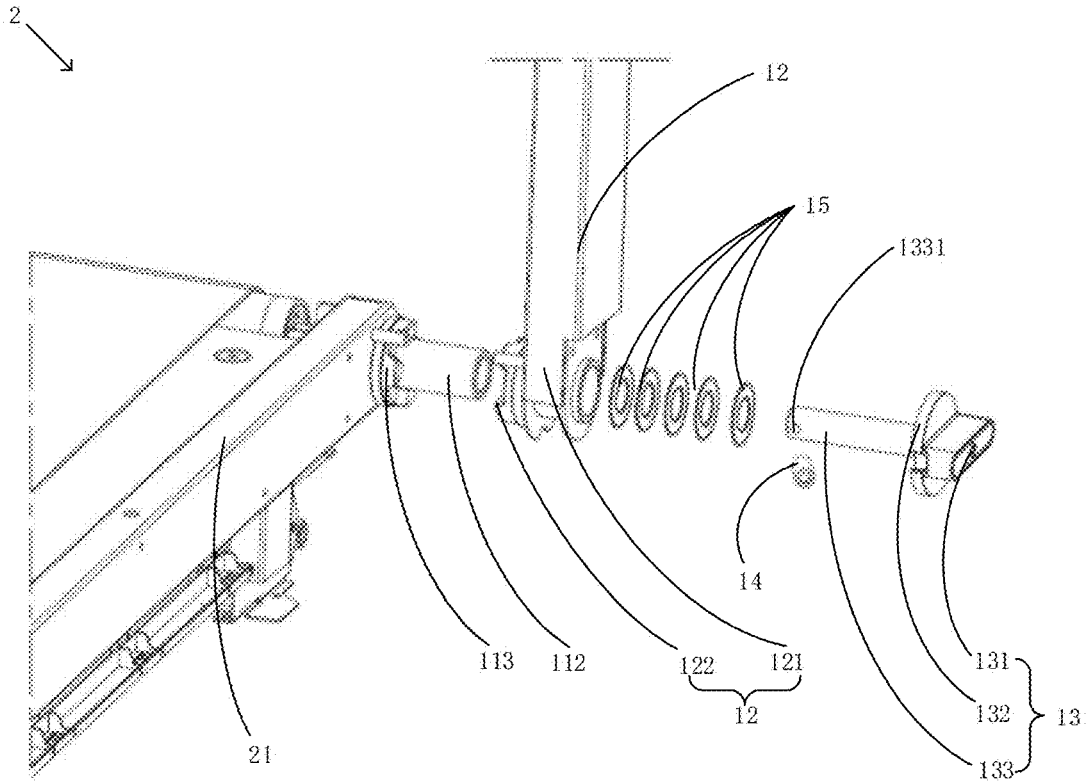
FIG. 7 is an exploded view of a treadmill according to an illustrative embodiment of the present disclosure.

In some embodiments, as shown in FIGS. 5 and 7, the locking member 13 includes an operating part 131, a connecting part 133 and a pushing part 132 arranged between the operating part 131 and the connecting part 133. The connecting part 133 is threadedly connected with the rotating shaft 112, and the pushing part 132 protrudes beyond the connecting part 133 and the operating part 131 in the radial direction. The above structure of the locking member 13 allows to adjust the position of the threaded connection between the connecting part 133 and the rotating shaft 112 by rotating the operating part 131, and also allows the locking member 13 to abut against the upright post 12 by the pushing part 132. The pushing part 132 can also move away from the upright post 12 by rotating the operating part 131, so that the second chuck 122 can move in the axial direction to be disengaged from the first chuck 113. The connecting part 133 can be a columnar structure with threads on its outer surface, and an end of the rotating shaft 112 facing away from the pushing part 132 can have a threaded hole in the axial direction, and the connecting part 133 is inserted into the threaded hole and is threadedly connected in the threaded hole through the threads on the columnar structure.

In the above embodiments, a free end of the connecting part 133 facing away from the pushing part 132 may include a limiter 14, and the limiter 14 includes a limiting structure protruding beyond the connecting part 133 in the radial direction. An axial displacement of the locking member 13 can be limited by the limiter 14 to prevent the locking member 13 from falling off in the axial direction. The free end of the connecting part 133 can have a limiting hole 1331, and the limiter 14 can be a screw, a stud or the like inserted into the limiting hole 1331, which is not limited by the present disclosure.

In some embodiments, the treadmill may further include at least one elastic member 15, which is fitted over the connecting part 133 and located between the pushing part 132 and the upright post 12. The elastic member 15 can not only ensure the abutting effect of the locking member 13 on the upright post 12, but also generate an axial thrust acting on the upright post 12 by using its own elasticity, so that the second chuck 122 can snap the disengaged protrusion 17 into the next groove 18 in the rotating and folding state, and thus the upright post 12 can obtain another suspending, folding or unfolding angle. The elastic member 15 can be a disc spring, and a plurality of disc springs can be arranged between the upright post 12 and the pushing part 132 to obtain the expected elastic abutting effect.

During the rotation of the upright post 12, the engaged protrusions on the second chuck 122 of the upright post 12 will be squeezed out, and the elastic member 15 will be compressed. When folded or unfolded in place, the protrusions 17 of the first chuck 113 and the second chuck 122 are aligned and fitted with the grooves 18 of the first chuck 113 and the second chuck 122, the elastic member 15 releases the elastic force to push the protrusions 17 of the second chuck 122 into the grooves 18 of the first chuck 113, the protrusions 17 of the first chuck 113 are snapped into the grooves 18 of the second chuck 122, and then the locking member 13 is switched to the locked position to abut against the upright post 12.

In some embodiments, two above upright posts 12 can be connected by an armrest assembly 22, one end of a body 121 of the upright post 12 has the second chuck 122, and the armrest assembly 22 can be arranged at the other end of the body 121. Assembling positions 211 can be provided on two sides of an end of the running deck and belt assembly 21, respectively, and the two upright posts 12 are fixedly assembled in the assembling positions 211, respectively, so as to obtain symmetrically arranged upright posts 12 on the two sides of the running deck and belt assembly 21.

In some embodiments, when the locking member 13 is switched to the unlocked position, the user exerts a force on the upright post 12, and the second chuck 122 can be disengaged from the first chuck 113 to enter the rotating and folding state under the action of the force, so that the upright post 12 can realize the functions of folding and suspending at the preset angle relative to the running deck and belt assembly 21. When the locking member 13 is switched to the locked position, the locking member 13 abuts against the upright post 12, so that the second chuck 122 is snapped into the first chuck 113 to fix the upright post 12. At this time, the relative position of the upright post 12 and the running deck and belt assembly 21 is fixed. The upright post 12, the armrest assembly 22 and other structures of the treadmill 2 are folded or suspended at any angle relative to the running deck and belt assembly 21, which improves the convenience of storage and use.

The above embodiments are only the preferred embodiments of the present disclosure, and are not used to limit the present disclosure. Any modification, equivalent substitution, improvement and so on made within the spirit and principle of the present disclosure should be included in the scope of protection of the present disclosure.

The invention claimed is:

1. A treadmill, comprising:

a running deck and belt assembly; and an upright post arranged at a front end of the running deck and belt assembly, wherein the upright post is movably connected with the running deck and belt assembly through a movable connecter, and configured to rotate relative to the running deck and belt assembly around the movable connecter which serves as a fixed point, to allow the treadmill to have a used state and a folded state during rotation, wherein the used state refers to a state that the upright post is perpendicular or approximately perpendicular to an upper surface of the running deck and belt assembly, and the folded state refers to a state that the upright post is parallel or approximately parallel to the upper surface of the running deck and belt assembly, wherein the upright post has a suspended state in the process of rotating relative to the running deck and belt assembly around the movable connecter which serves as the fixed point, wherein the suspended state refers to a state that an included angle between the upright post and the upper surface of the running deck and belt assembly is any value more than 0 degrees and less than 90 degrees, wherein the movable connecter comprises:

a rotating shaft fixed to the running deck and belt assembly, and having a hollow interior to define a locking cavity; and a shaft sleeve fixed to a lower end of the upright post and sized to be fitted over the outer surface of the rotating shaft across a whole length of the shaft sleeve.

2. The treadmill according to claim 1, wherein the movable connecter comprises:

a first chuck fixed to the running deck and belt assembly and fitted over an outer surface of the rotating shaft;

a second chuck fixed to a side of the shaft sleeve facing the running deck and belt assembly and fitted over the outer surface of the rotating shaft; and a locking member embedded in the locking cavity in the rotating shaft and connected with the rotating shaft, and configured to move relative to the rotating shaft in an axial direction of the rotating shaft under the action of an external force.

3. The treadmill according to claim 2, wherein the first chuck and the second chuck both comprise a protrusion and a groove; and the protrusion and the groove of the first chuck are fitted with the groove and the protrusion of the second chuck to allow the first chuck and the second chuck to be engaged with each other.

4. The treadmill according to claim 3, wherein the first chuck and the second chuck are configured to be engaged with each other when the locking member moves towards the rotating shaft to a first predetermined position under the action of the external force; and the first chuck and the second chuck are configured to be disengaged when the locking member moves away from the rotating shaft to a second predetermined position under the action of the external force.

5. The treadmill according to claim 3, wherein a lateral surface of the protrusion of each of the first chuck and the second chuck is inclined relative to the axial direction; and the protrusion of the first chuck is configured to be snapped into the groove of the second chuck and the protrusion of the second chuck is configured to be snapped into the groove of the first chuck, when the second chuck is engaged with the first chuck.

6. The treadmill according to claim 3, wherein the groove of each of the first chuck and the second chuck comprises an inner opening and an outer opening oppositely arranged in a radial direction of the first chuck or the second chuck, and a circumferential dimension of the outer opening is larger than a circumferential dimension of the inner opening.

7. The treadmill according to claim 3, wherein the first chuck and the second chuck both comprise at least two grooves.

8. The treadmill according to claim 3, wherein the groove of each of the first chuck and the second chuck comprises a first groove and a second groove; and the first groove structurally matches with the protrusion, and a circumferential dimension of the second groove is larger than a circumferential dimension of the protrusion.

9. The treadmill according to claim 8, wherein the first groove and the second groove are alternately arranged.

10. The treadmill according to claim 2, wherein an outer surface of the locking member has male threads, an inner surface of the locking cavity of the rotating shaft has female threads, and the locking member is connected with the rotating shaft through thread fit.

11. The treadmill according to claim 2, wherein the locking member comprises an operating part, a connecting part and a pushing part arranged between the operating part and the connecting part;

the connecting part is threadedly connected with the rotating shaft; and the pushing part protrudes beyond the connecting part and the operating part in the radial direction.

12. The treadmill according to claim 11, wherein a free end of the connecting part facing away from the pushing part comprises a limiter, and the limiter comprises a limiting structure protruding beyond the connecting part in the radial direction.

13. The treadmill according to claim 11, further comprising at least one elastic member fitted over the connecting part and located between the pushing part and the upright post.

* * * * *